United States Patent [19]

Smith

[11] Patent Number: 4,925,339

[45] Date of Patent: May 15, 1990

[54] EXPANSION JOINT COVER AND DRAIN

[76] Inventor: Earl M. Smith, 545 S. Lexington Pkwy., St. Paul, Minn. 55116

[21] Appl. No.: 335,897

[22] Filed: Apr. 10, 1989

[51] Int. Cl.[5] ..... E01C 11/22; E04B 1/68

[52] U.S. Cl. ..... 404/47; 52/573; 404/74

[58] Field of Search ..... 404/47, 56–58, 404/67, 68, 69, 74; 405/118, 119, 121; 52/573, 11, 13, 464

[56] References Cited

U.S. PATENT DOCUMENTS

| | | | |
|---|---|---|---|
| 1,334,178 | 3/1920 | Sharp | 52/573 X |
| 1,357,713 | 11/1920 | Lane | 52/464 |
| 2,066,052 | 12/1936 | Plym | 404/58 |
| 3,092,218 | 6/1963 | Clay | 52/573 X |
| 3,331,171 | 7/1967 | Hallock | 52/278 |
| 3,659,390 | 5/1972 | Balzer et al. | 52/573 X |
| 3,750,359 | 8/1973 | Balzer et al. | 52/468 |
| 4,156,993 | 6/1979 | Sorrells, Jr. | 52/60 |
| 4,295,315 | 10/1981 | Lynn-Jones et al. | 52/573 |
| 4,616,954 | 10/1986 | Taga | 404/74 |
| 4,663,894 | 5/1987 | LaRoche et al. | 52/15 |
| 4,848,044 | 7/1989 | LaRoche et al. | 404/68 X |

OTHER PUBLICATIONS

Erie Metal Specialties, Inc., Polycrete/Membrane Expansion Joint System, 4 pp.

Interspan Publication, The Flexible Expansion Joint System, 2 pp.

Flat Seam Roofing, 1 p.

*Primary Examiner*—Stephen J. Novosad

*Attorney, Agent, or Firm*—Charles G. Mersereau

[57] ABSTRACT

A system for protecting and draining expansion joints joining juxtaposed discrete sections of construction materials is disclosed in which a pair of laterally disposed sheet members having free ends rebent into moveably interlocked curves, and secured ends fixed to the construction material sections cooperate to form a liquid collector between the sections of construction materials such that compensation for changes in the width of the gap is accomplished by relative movement of the interlocked curves. A cover member spans the joint above the sheet members.

11 Claims, 2 Drawing Sheets

EXPANSION JOINT COVER AND DRAIN

BACKGROUND OF THE INVENTION

1. Field of the Invention

The present invention relates generally to the field of expansion joints for pavement or the like and, more particularly, to a new expansion joint cover and drain system applicable to elevated concrete pavements, such as those found in bridge decking, parking ramps and the like.

2. Related Art

In building roadway structures using large sections of monolithic concrete or other construction materials, it is necessary to provide expansion joints between the sections to compensate for temperature-related expansion and contraction and other phenomena which produce relative motion of the abutting sections. The simplest form of expansion joint, of course, consists merely of a gap between adjacent sections of material. The gap may be filled with some type of resilient material. Commonly, however, unless such an expansion joint or gap is covered in some manner, foreign material such as dirt, pebbles or the like soon clogs the joint in the contracted or open state and thereafter renders it useless to compensate for expansion.

If it be located out in the open, the expansion joint further is exposed to the elements and accumulations of water, ice and snow. If the joint be elevated, runoff or seepage of water through or about the joint is an important consideration to be addressed. This occurs in bridge decks or multilevel structures such as parking ramps or the like where drainage directly through the joint to the area below is undesirable. Provision must be made to collect and drain off any liquid material entering the joint.

Expansion joint covers which include provision for runoff or drain seals are known generally. Examples are found in U.S. Pat. Nos. 4,295,315, 3,750,359 and 1,357,713. These and other previous attempts primarily present rather complicated or expensive structures or ones which will not withstand the punishment of motor vehicle traffic. Many have liquid collectors or troughs which include sheet metal sections which flex with each expansion and contraction of the joint thereby severely limiting life expectancy. Thus, there remains a need for a relatively inexpensive pavement expansion joint system which includes provision for a cover and for removing fluid which otherwise would leak through the joint.

SUMMARY OF THE INVENTION

The present invention provides a low-cost expansion joint cover and drain combination which provides long-term, trouble-free service. The system contemplates relative ease of installation for retrofitting, minimizing the number of parts or components required and eliminating the flexing of collection trough material. The system is designed to span juxtaposed sections of building or paving material in a manner which does not put stress on either the building or paving material sections themselves or on the expansion joint cover and drain system during the full range of expansion and contraction of the material sections.

A plate member fixed to one of the two abutting material sections involved is slideably attached to the second so as to span the top of the expansion joint. The two abutting material sections are provided with juxtaposed top notches facing each other beneath the spanning plate member to accommodate a collection trough drainage system. The drainage system includes a pair of interlocking flashing strips, one fixed to each of the adjacent juxtaposed material sections addressing the expansion joint. Each of the pair of flashing strips or sheet members is secured to the opposite on of the material sections. The flashing strips have free ends rebent into moveably interlocked curves such that the entire relative motion of expansion and contraction is taken up in the relative motion of the interlocked loops. No flexing of the flashing strips occurs during expansion and contraction. One of the flashing strips serves as a sealing member and the other as the drain collector member. The liquid collector member may be suitably sloped toward one or both ends of the expansion joint along the length thereof to provide for draining of the collected liquid.

DESCRIPTION OF THE DRAWINGS

In the drawings wherein like numerals are utilized to depict like parts throughout the same.

DESCRIPTION OF THE PREFERRED EMBODIMENTS

The Figures illustrate the basic concepts or principles involved in the integral expansion joint cover and drainage system of the invention. The side elevational view of FIG. 1*a* best depicts the drainage or runoff collection trough or envelope involved in the system and the sectional views of FIGS. 2 and 3 best depict the interaction of the interlocking curved flashing members of the runoff collection or drain system with the adjacent material sections and the cover.

Figure 1A:
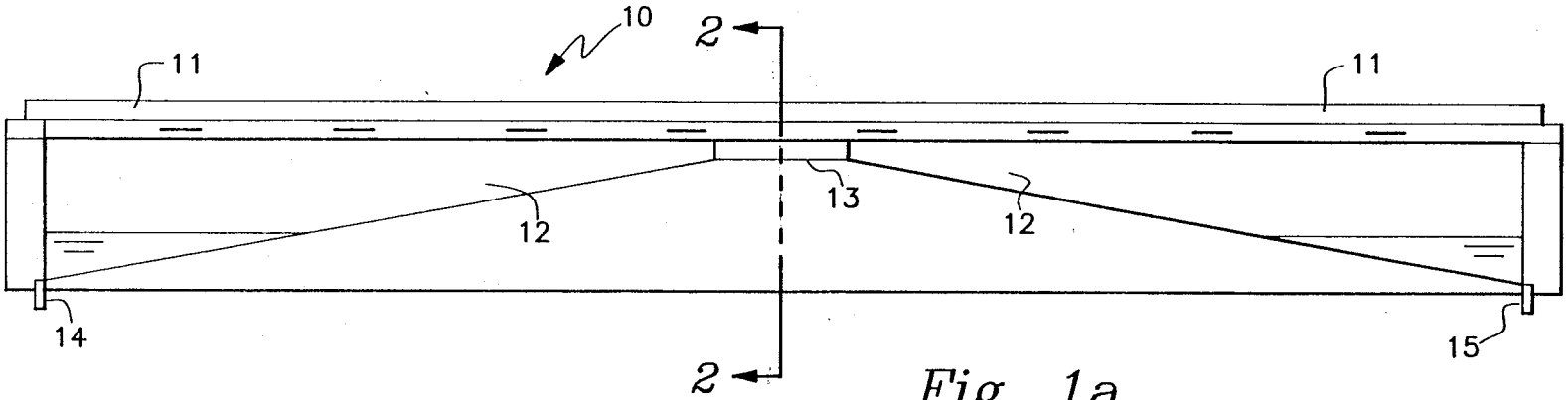
FIG. 1*a* is the side elevational view depicting the integral expansion joint cover and drainage system of the invention.

The system generally is noted by 10 in FIG. 1*a* and contains a collection or drainage flashing member 12 which is illustrated as sloping away from a central area 13, in an exaggerated manner, to oppositely disposed drains 14 and 15 which may be part of an overall gutter or draining scheme (not shown) which would occur to those skilled in the art and might be installed in a multilevel structure such as a parking ramp.

Figure 1B:
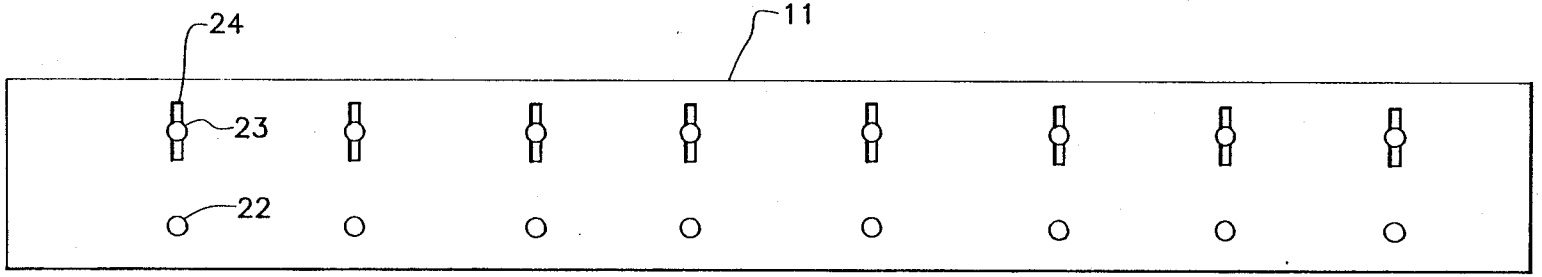
FIG. 1*b* is a top view of the system of FIG. 1.
Figure 2:
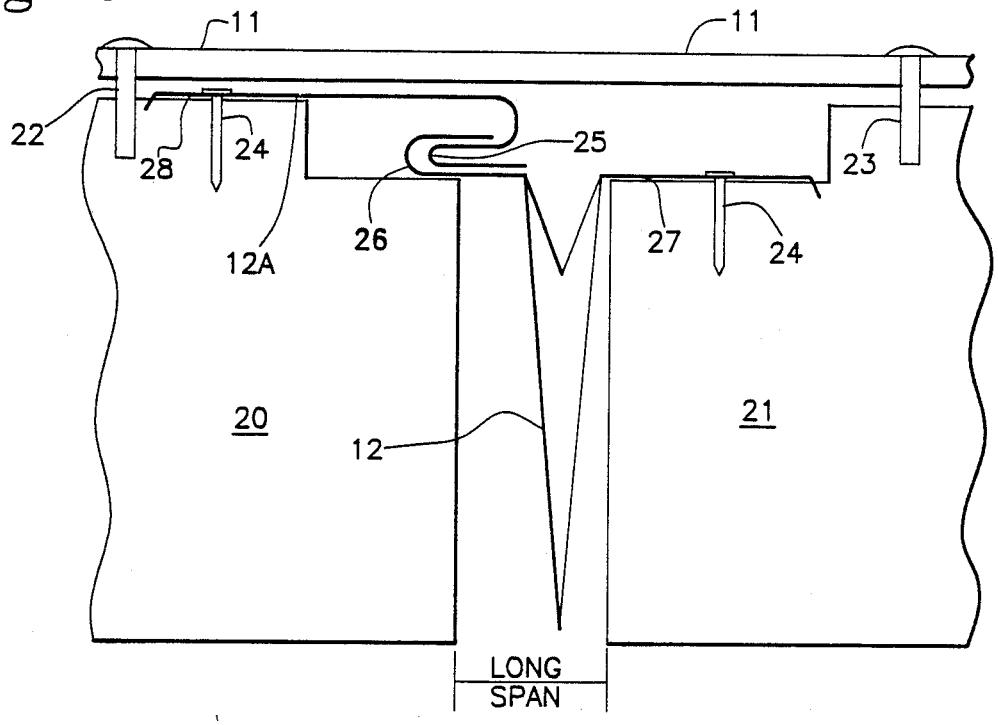
FIG. 2 is a sectional view taken along line 2—2 of FIG. 1*a* with the system in place between adjacent jointed material sections which are shown in a contracted disposition.

As is better illustrated in FIGS. 1*b* and 2, a cover plate 11 spans the entire width of the top of the expansion joint between adjacent material sections 20 and 21. The cover plate 11 is fixed to one of the adjacent material sections as illustrated by the fasteners 22. The opposite side of the plate 11 is mounted to the material section 21 as by fasteners 23. As seen in FIG. 1*b*, the plate 11 contains a series of spaced parallel slots 24 of a width greater than the fastener 23 but less than the fastener head such that the free end of member 11 is free to move laterally in the longitudinal direction of the slot relative to the separation of the sections 20 and 21.

Figure 3:
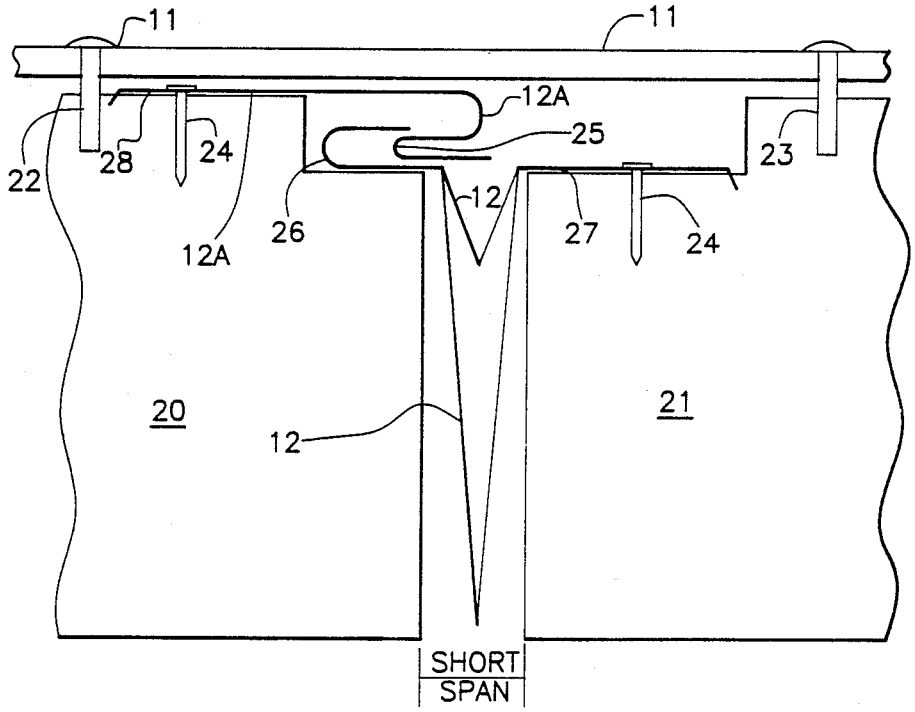
FIG. 3 is the likeness of FIG. 2 with the adjacent jointed material sections shown in an expanded position.

Rebent, interlocking flashing members including the drainage member 12 and a further member 12A are depicted in FIGS. 2 and 3. The members 12 and 12A are respectively secured to material members 20 and 21 as by fasteners 24, and are configured with free ends rebent into moveably interlocked curves such that curve 25 in member 12A freely, slideably fits within curve 26 of member 12. In this manner, the only necessary relative motion of the members 12 and 12A during expansion and contraction of the adjacent members 20 and 21 involves changes in the depth of the slideably engaging interlock of curves 25 and 26. It is further noteworthy that the system can be compensated such that during the expansion and contraction operation of the joint and collection system no flexing of the relatively thin members 12 and 12A is required. At the same time, the system maintains a liquid-tight seal to collect runoff between the sections 20 and 21.

The cover plate 11 may be a metal plate of a suitable thickness commensurate with the anticipated load to be borne by the system. Of course, if circumstances dictate, open grading, or the like, may be used in place of a steel plate for certain applications. The material of the relatively thin members 12 and 12A may, for example, be brass or copper strip or any other material which is suitably weather and corrosion resistant, or made so by proper coating or other treatment. Of course, it is anticipated that any suitable plastic or polymeric materials in extrudable or sheet form may be substituted for the metal where appropriate.

It should be noted that the two laterally disposed rebent sheet or flashing strips are correlated so that the moveably interlocked rebent free ends are interlocked to the greatest degree when the gap in the expansion joint is narrowest and are still interlocked but to a lesser degree when the gap in the expansion joint is widest. It is necessary to maintain a complete seal that the bent free margins of the respective flashing strips or sheet members still overlap slightly when the gap is the widest. The arrangement avoids or reduces flexing or bending of the flashing or sheet members over the entire expansion/contraction cycle of the joints eliminating flex wear. Calking as at 27 and 28 (FIGS. 2 and 3) may be used to complete the liquid-tight collection system. This eliminates seepage which otherwise might occur.

Having thus described the invention, what is claimed is:

1. A system for protecting and draining expansion joints joining juxtaposed sections of construction materials of varying gap width comprising:

a pair of laterally disposed sheet members having free ends rebent into moveably interlocked curves, and having secured ends each of which is secured to the corresponding opposite one of said construction material sections, the pair of laterally disposed sheet members cooperating to form a liquid collector between the sections of construction material and wherein at least a portion of the compensation for change in the width of the gap is accomplished by relative movement of the interlocked curves; and cover member spanning the expansion joint above said pair of laterally disposed sheet members, and fixed to at least one of said juxtaposed sections of construction material.

2. A system for protecting and draining expansion joints joining juxtaposed sections of construction materials of varying gap width comprising:

a pair of laterally disposed sheet members having their free ends rebent into moveably interlocked curves, wherein each of said pair of laterally disposed sheet members has its other end secured to the corresponding opposite one of said sections of construction material, the pair of laterally disposed sheet members cooperating to form a liquid collector between said sections of construction material and wherein all of the compensation for changes in the width of the gap is accomplished by relative movement of the interlocked curves; and cover member spanning the expansion joint above said pair of laterally disposed sheet members, and fixed to at least one of said juxtaposed construction material sections.

3. A system for protecting and draining expansion joints joining juxtaposed sections of construction materials of varying gap width comprising:

a pair of laterally disposed sheet metal members having free ends rebent into moveably interlocked curves, wherein each of said pair of laterally disposed sheet metal members has its other end secured to the corresponding opposite one of said sections of construction material, the pair of laterally disposed sheet members cooperating to form a liquid collector between said sections of construction material and wherein at least a portion of the compensation for change in the width of the gap is accomplished by relative movement of the interlocked curves; and a cover member spanning the expansion joint above said pair of laterally disposed sheet members, and fixed to at least one of said juxtaposed construction material sections.

4. The system of claim 1 wherein said cover member is slideably fixed to one of said construction member sections.

5. The system of claim 2 wherein said cover member is slideably fixed to one of said construction member sections.

6. The system of claim 3 wherein said cover member is slideably fixed to one of said construction member sections.

7. The system of claim 1 wherein said sheet members are a polymeric material.

8. The system of claim 2 wherein said sheet members are a polymeric material.

9. The system of claim 3 wherein all the compensation for changes in the width of the gap is accomplished by relative movement of the interlocked curves.

10. The system of claim 3 wherein the metal of the sheet metal member is selected from the group consisting of copper and brass.

11. The system of claim 9 wherein the metal of the sheet metal member is selected from the group consisting of copper and brass.

* * * * *